US005529298A

United States Patent [19]

Gough et al.

[11] Patent Number: 5,529,298

[45] Date of Patent: Jun. 25, 1996

[54] INFEED APPARATUS

[75] Inventors: Rex M. Gough, Cambridge; Graham Cook, Essex, both of United Kingdom

[73] Assignee: Pitney Bowes plc, Harlow

[21] Appl. No.: 279,667

[22] Filed: Jul. 25, 1994

Related U.S. Application Data

[63] Continuation of Ser. No. 31,765, Mar. 15, 1993, abandoned.

[30] Foreign Application Priority Data

Mar. 17, 1992 [GB] United Kingdom ..... 9205805

[51] Int. Cl.[6] ..... B65H 5/26

[52] U.S. Cl. ..... 271/9.09; 270/56

[58] Field of Search ..... 271/9, 227, 228, 271/245, 246, 258, 265, 262, 263; 270/55, 56

[56] References Cited

U.S. PATENT DOCUMENTS

| | | | |
|---|---|---|---|
| 3,283,163 | 11/1966 | Folmar | 271/263 X |
| 3,679,202 | 7/1972 | Rauffer | 271/57 |
| 3,873,843 | 3/1975 | Martin | 250/561 |
| 4,394,008 | 7/1983 | Sugiyama | 271/265 X |
| 4,424,964 | 1/1984 | Kikuchi et al. | 271/9 |
| 4,483,528 | 11/1984 | Takeyama et al. | 271/9 |
| 4,533,133 | 8/1985 | Hams | 271/9 |
| 4,697,246 | 9/1987 | Zemke et al. | 364/563 |
| 4,871,160 | 10/1989 | Yoshino | 271/9 |
| 4,896,871 | 1/1990 | Idenawa | 271/9 |
| 4,900,173 | 2/1990 | Okamura | 271/9 |
| 4,906,842 | 3/1990 | Melcher | 250/205 |
| 4,922,110 | 5/1990 | Melcher | 250/556 |
| 4,966,358 | 10/1990 | Yokoi et al. | 271/9.01 |
| 5,067,704 | 11/1991 | Tsuihiji et al. | 271/262 |
| 5,069,435 | 12/1991 | Mizutani | 271/9 X |
| 5,156,385 | 10/1992 | Muto et al. | 271/265 X |
| 5,171,006 | 12/1992 | Naito | 271/245 X |
| 5,228,680 | 7/1993 | Sugiura | 271/265 X |

FOREIGN PATENT DOCUMENTS

| | | | |
|---|---|---|---|
| 0052344 | 5/1981 | Japan | 271/9 |
| 0067431 | 4/1982 | Japan | 271/9 |
| 0006540 | 1/1985 | Japan | 271/9 |
| 0140945 | 6/1987 | Japan | 271/9 |
| 0211250 | 9/1987 | Japan | 271/9 |
| 0074838 | 4/1988 | Japan | 271/9 |
| 0230435 | 9/1988 | Japan | 271/9 |
| 0262343 | 10/1988 | Japan | 271/9 |
| 0028134 | 1/1989 | Japan | 271/9 |
| 0028127 | 1/1989 | Japan | 271/9 |
| 0127349 | 5/1990 | Japan | 271/9 |
| 2068907 | 8/1981 | United Kingdom | 271/9 |

*Primary Examiner*—William E. Terrell
*Assistant Examiner*—Tamara Kelly
*Attorney, Agent, or Firm*—Charles R. Malandra, Jr.; Melvin J. Scolnick

[57] ABSTRACT

In the field of sheet handling apparatus such as a mail processing machine, it is known to provide infeed apparatus which allows for both the manual and automatic feeding of inserts for processing.

The disclosure relates to such infeed apparatus (10) including sensor means (32,33) for detecting (i) whether more than one insert has been fed automatically from one insert tray (13); or (ii) whether an insert has been fed manually from another insert tray (14). In the former case, the apparatus is arranged to signal a fault to an operator; in the latter case operation of the apparatus is automatically continued on sensing of a correctly fed, manually fed insert.

17 Claims, 2 Drawing Sheets

INFEED APPARATUS

Figure 1:
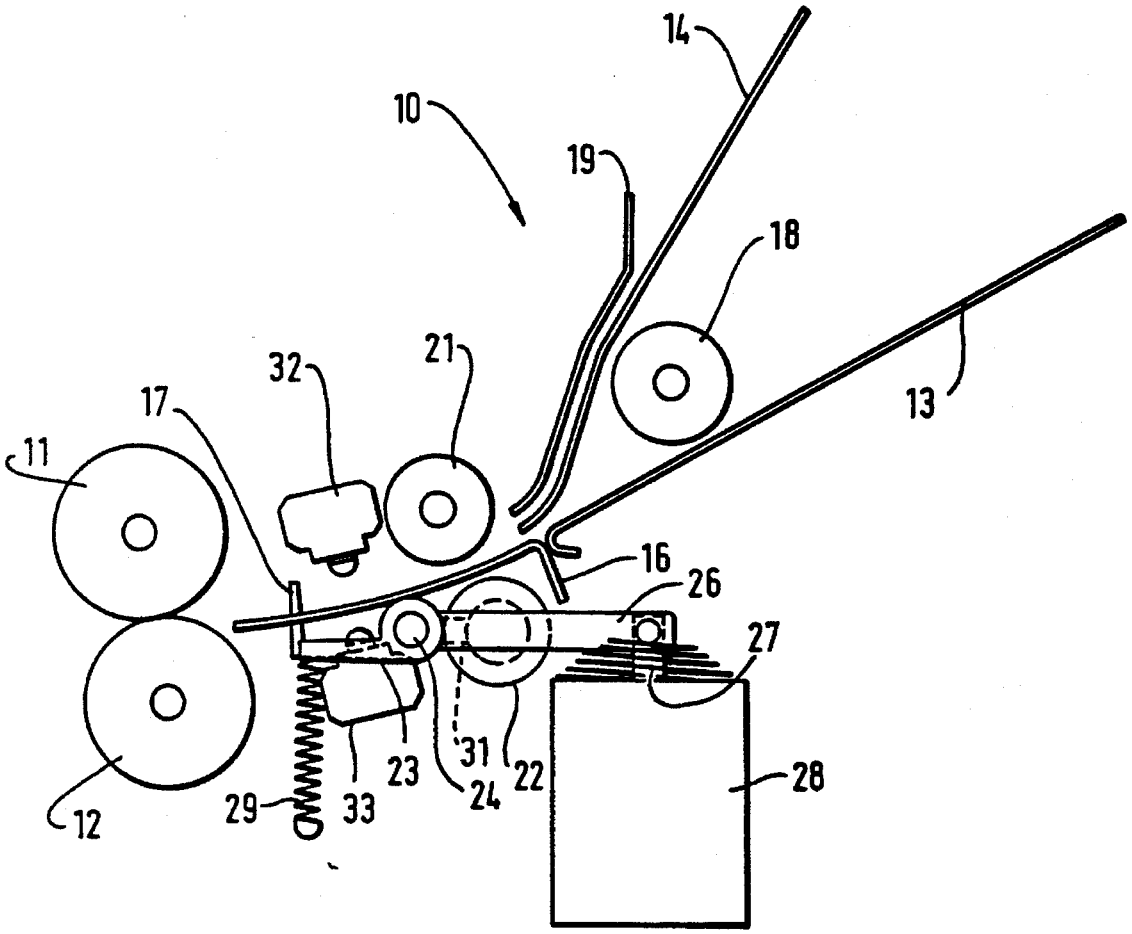

This application is a continuation-of-application Ser. No. 08/031,765, filed Mar. 15, 1993 abandoned.

This invention relates to an infeed apparatus for sheet handling apparatus. By "sheet handling apparatus" is meant any apparatus which is capable of handling or processing sheet like, generally flexible items. In particular, the term includes apparatus for handling and processing mailpieces. Such apparatus may be, for example, a postage meter for printing postage value indicia onto mailpieces, or a folder inserter for folding inserts and inserting them into envelopes.

Such apparatus is fed with, for example, inserts and envelopes from insert trays forming part of an infeed apparatus. It is known to provide an infeed apparatus in which the feeding of inserts takes place generally automatically, with the option of manual feeding of inserts by an operator. In the known apparatus, the automatically fed inserts are stacked in an insert tray and fed singly through the infeed apparatus to the sheet handling apparatus by means, for example, of a drive roller which draws the uppermost or lowermost insert, as appropriate, from the stack in timed relationship with the operation cycle of the sheet handling apparatus. The manually fed inserts are inserted singly into a further insert tray by an operator, and are either driven by drive rollers or fed under gravity through the infeed apparatus towards the sheet handling apparatus.

By "insert tray" as used herein is meant any platform, cradle or support which serves to support inserts or other sheet like, flexible items in the infeed apparatus.

The known infeed apparatus of this type suffers the disadvantage that, when manual feeding of an insert is desired, the operator must interrupt the automatic operation of the apparatus by the manual feeding of an insert. The operator must then intervene again to re-start the infeed apparatus, and, optionally, the sheet handling apparatus once the manual feeding has been completed. This is inconvenient and time consuming.

According to the invention there is provided an infeed apparatus for sheet handling apparatus comprising a first insert tray, a second insert tray, a collation station, one or more feed paths connecting the collation station to the respective insert trays, means for temporarily arresting inserts at the collation station, and drive means for inserts, the drive means being disposed to drive inserts from the first insert tray to the collation station, said first insert tray being arranged for the automatic feeding of inserts to the collation station and said second insert tray being arranged for the manual feeding of inserts to the collation station, wherein the apparatus includes sensor means for selectively automatically sensing (i) whether more than one insert has been fed from one of the insert trays to the collation station; or (ii) whether an insert has been fed from the other insert tray to said collation station.

When the infeed apparatus of the invention is operatively connected to control apparatus (such as may be present in the sheet handling apparatus), it permits the automatic detection of the feeding of "doubles" from the first insert tray, and also the automatic re-commencement of operation of the infeed apparatus and optionally the sheet handling apparatus on manual feeding of an insert via the second insert tray.

Figure 2:
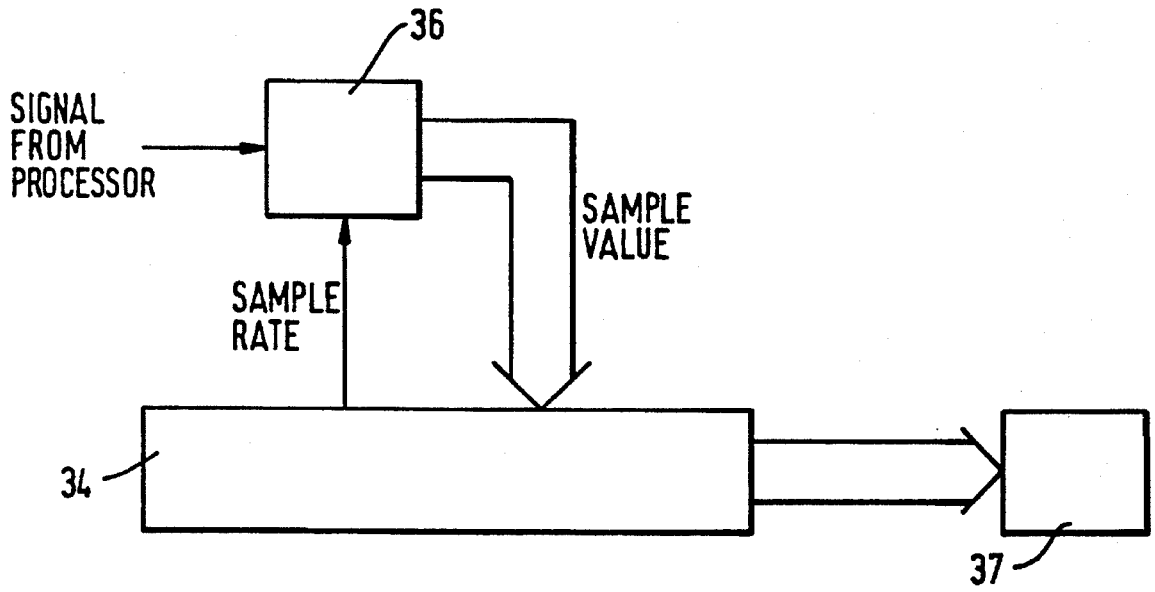
Figure 3:
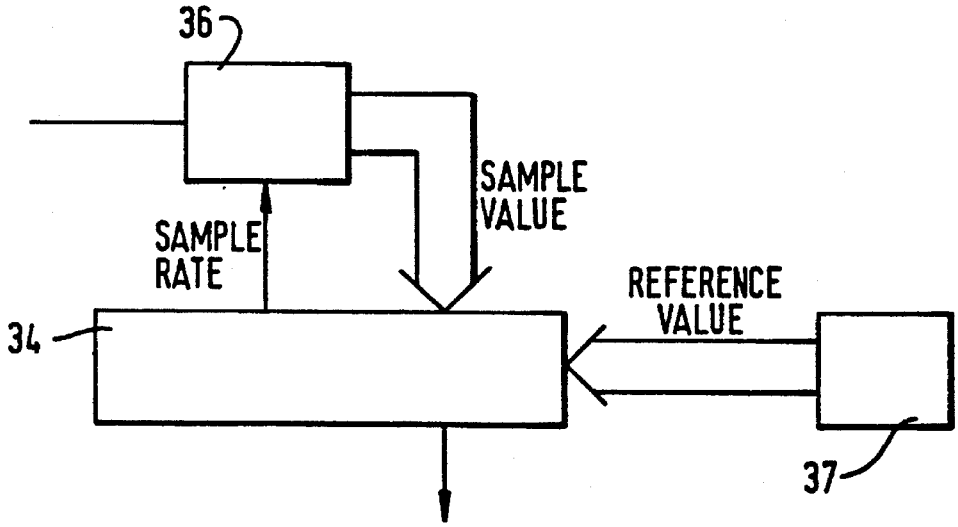

There now follows a description of a preferred embodiment of the invention, by way of example, with reference being made to the accompanying drawings in which:

FIG. 1. is a schematic view of an infeed apparatus according to the invention;

FIG. 2. is a block diagram of suitable control apparatus for the invention, the control apparatus being configured to operate in a calibration mode; and FIG. 3. is a block diagram of the control apparatus when configured to operate in an active (sampling) mode.

Referring to the drawings, there is shown an infeed apparatus 10 for feeding inserts or other sheet like articles to a sheet handling apparatus. In the embodiment shown, the infeed apparatus feeds inserts, etc. to the fold rollers 11, 12 of a folder inserter machine, although the infeed apparatus can be arranged to feed various types of apparatus.

The infeed apparatus includes a first insert tray 13 which is arranged for the automatic feeding of inserts, etc. The infeed apparatus also includes a second insert tray 14 which is arranged for the manual feeding of inserts, etc.

There is provided a collation station comprising a cross member 16 and a gate 17 moveable between two positions in one of which the gate 17 protrudes upwardly beyond the upper surface of cross member 16 and in the other of which gate 17 is retracted below the level of cross member 16. A suitable aperture for gate 17 may be formed in cross member alternatively gate 17 may comprise one or more members moveable adjacent the side edge of cross member 16.

The insert trays 13, 14 and the cross member 16 constitute a pair convergent feed paths for inserts through the infeed apparatus. The first feed path is that from insert tray 13 onto cross member 16 and the second is from insert tray 14 onto cross member 16.

The ends of the respective insert trays adjacent the cross member 16 are open and are directed such that inserts in the respective insert trays tend to travel towards the cross member 16. The inserts are directed onto the upper, inclined surface of cross member 16. (It will be appreciated that cross member 16 need not be inclined. However, the passage of inserts is assisted by the inclination of cross member 16.)

Disposed adjacent the upper surface of first insert tray 13 is a driven feed roller 18 driven by motor means (not shown). Roller 18 is disposed such that driven rotation thereof causes the uppermost insert of a stack of inserts residing in insert tray 13 to be driven from tray 13 onto cross member 16. It will be appreciated that if the motor means for roller 18 are suitably controlled, the automatic feeding of inserts from first insert tray 13 to cross member 16 can be effected. Optionally, there is disposed in the vicinity of insert tray 13 a separator mechanism (not shown) which may be of a conventional kind used in this kind of apparatus for attempting to ensure that inserts are fed only singly from insert tray 13. Alternative arrangements may be devised, in which the lowermost insert of a stack in tray 13 is fed each time.

The upper surface of insert tray 13 is inclined to the horizontal, in such a way that a smooth path onto cross member 16 exists. The upper surface of insert tray 14 is inclined at a steeper angle in the embodiment shown than that of insert tray 13. This means that the feeding of inserts via insert tray 14 is assisted considerably by gravity. A cover plate 19 is provided to constrain inserts fed manually against the upper surface of insert tray 14. The inclination and shape of insert tray 14 are such as to provide a smooth path onto cross member 16.

A pair of rollers 21, 22 are disposed to either side of cross member 16. The upper roller 21 is a driven roller. The lower roller 22 is an idler roller. Idler roller 22 is moveable between a first position in which it is disposed below cross member 16 and a second position in which part of the roller protrudes beyond member 16. This may be either through an aperture in the surface of cross member 16, or by passage of part of roller 22 to one side of member 16. There may be provided more than one roller 22, and indeed any of the rollers described herein may similarly be composite rollers made up of numerous elements. The mechanism by which movement of roller 22 is effected is described below.

Gate 17 is supported on an arm 23 disposed below cross member 16. The end of arm 23 remote from gate 17 is constituted by a pivot 24. A further arm 26 is rigidly secured to arm 23 and extends parallel to arm 23 on the opposite side of pivot 24. Pivot 24 is secured to the chassis or frame of the infeed apparatus. It will therefore be apparent that a downward motion of arm 26 causes pivoting of both arm 26 and arm 23 about pivot 24, to raise gate 17. The end of arm 26 remote from pivot 24 is pivotably secured to an actuator member 27 of a linear solenoid 28. Solenoid 28 is connected to a power supply and appropriate control means. When solenoid 28 is actuated, as a result of the interconnection of the components the arm 26 moves downwardly causing arm 23 to pivot upwardly about pivot 24, thereby raising gate 17 through an aperture in cross member 16 to block the passage of inserts along cross member 16. A spring 29 secured at one end to the frame or chassis of the infeed apparatus and at the other to arm 23 biasses gate 17 into its retracted position, so that it blocks the passage of inserts only on actuation of solenoid 28.

A further arm 31 is rigidly secured to arms 23 and 26 at one end and at the other to idler roller 22. Thus, when solenoid 28 is actuated idler roller 22 is withdrawn below cross member 16 and the drive of inserts along cross member 16 is halted because there exists no nip between rollers 21 and 22. When solenoid 28 is deactivated, spring 29 causes the retraction of gate 17 and, because of the interconnection of the components, the simultaneous advancing of roller 22 to protrude through cross member 16 and form a nip between roller 22 and roller 21 to drive inserts from cross member 16 towards the sheet handling apparatus.

A through beam sensor constituted by light emitter 32 and light receiver 33 is arranged to pass a beam of light transversely through an aperture formed in cross member 16. Alternatively, the beam can be transmitted to one side of cross member 16, as long as cross member 16 is constructed such that the inserts which pass thereon overhang the edge adjacent which the beam passes.

The output of the through beam sensor 32, 33 is transmitted to a microprocessor 34 via an analogue to digital converter 36. The microprocessor is operatively connected to the control of the apparatus, and is arranged such that the infeed apparatus can discriminate between single, automatically fed inserts; inadvertent "doubles" fed automatically; and the combination of a single, automatically fed insert and a manually fed insert.

In the case of a single, automatically fed insert being detected, the control apparatus is arranged, in a preferred mode of operation, to raise the gate 17 in the feed path constituted by cross member 16 until a single, manually fed insert is detected. At this point, the gate 17 is lowered through deactivation of solenoid 28, idler roller 22 rises to create a nip and the inserts are driven to,yards the sheet handling apparatus by rollers 21 and 22.

In a preferred mode of operation, when two or more inserts (i.e. a "double") are accidentally fed from the first insert tray 13, the apparatus is arranged to arrest the roller 21 (and hence idler roller 22) thereby trapping the "double" in the collation station, ready for manual withdrawal.

Additionally, when a "double" is fed from the first insert tray the apparatus can, for example, be configured to raise the gate 17 (thereby simultaneously disengaging the idler roller 22). In either mode of operation, the apparatus can optionally be arranged to signal a warning via a display (not shown) to the operator of the machine.

It will be appreciated that the apparatus may optionally include more than one insert tray for either the automatic or manual feeding of inserts. In such a case, the control apparatus can be arranged to allow for further modes of detection at the through beam sensor 32, 33.

Generally, in preferred embodiments of the invention, the rollers 21 and 22 only operate together to feed inserts into the collation station when the automatic feeding of an insert is to be followed by manual feeding of a insert further, with collation of the inserts taking place as a result of subsequent raising of gate 17. Thus, in such a situation, the automatically fed insert is driven by roller 18 into the collation station. Rollers 21 and 22 are then disengaged from one another by lowering roller 22 (raising gate 17) and the manually fed insert is then passed via tray 14 into the collation station.

Generally, the feeding of inserts via tray 14 takes place entirely under the action of gravity. Furthermore, it will be appreciated that most insert sizes at least a portion of each insert will protrude rearwardly of the indeed apparatus (i.e. towards either tray 13 or tray 14) even when inserts abut the rollers 11 and 12.

FIGS. 2 and 3 show two modes of operation of the microprocessor in response to outputs from the through beam sensor.

In the mode shown in FIG. 2, the apparatus is arranged for calibration. In this mode, if a single insert is passed onto the cross member 16 (this is usually by automatic feeding from insert tray 13; however, the apparatus may be arranged to allow for calibration example by manual feeding from insert tray 14) the microprocessor stores in non-volatile memory 37 a sample value representative of the voltage detected at the through beam sensor 32, 33 corresponding to the thickness of a single insert.

If the apparatus is subsequently switched to an active mode as shown in FIG. 3, the voltage value corresponding to the thickness of a single insert is retrieved from a non volatile memory 37 and compared with the real time voltage value detected at the through beam sensor 32, 33. If the sample value detected by the microprocessor differs from that stored in the non-volatile memory 37, the apparatus either initiates a selected one of the procedures described above (in the event that a value corresponding to a double is detected) or the other procedure described above tin the event that the manual feeding of an insert is detected), dependent on the output received from the through beam sensor 32, 33 and, optionally, whether the output changes with time (as would occur in the case of a manual insert being fed subsequently to an insert arriving on the cross member 16 automatically from the first insert tray 13).

What is claimed is:

1. An infeed apparatus for a sheet handling apparatus comprising a first insert tray, a second insert tray, a collation station, at least one feed path connecting said collation station to the respective insert trays, means for temporarily arresting inserts at said collation station, and drive means for inserts, said drive means being disposed to drive inserts from the first insert tray to the collation station, said first insert tray being arranged for the automatic feeding of inserts to the collation station and said second insert tray being arranged for the manual feeding of inserts to the collation station, and sensor means for selectively automatically sensing one of;

(i) whether more than one insert has been fed from one of the insert trays to said collation station; and (ii) whether an insert has been fed from the other insert tray to said collation station.

2. An infeed apparatus according to claim 1 including control means operatively connected to the sensor means and capable of discriminating between the two kinds of sensing, a sensing of the feeding of more than one insert giving rise to a first signal type and a sensing of the manual feeding of an insert giving rise to a second signal type.

3. An infeed apparatus according to claim 2, wherein the second signal type comprises one signal part indicative of the automatic feeding of an insert and another signal part indicative of the manual feeding of an insert, the two signal parts occurring at different times, and the control means being capable of distinguishing said one signal part from said another signal part.

4. An infeed apparatus according to claim 1 wherein the apparatus is arranged in one of two arrangements, said first arrangement for the automatic feeding of an insert from the first insert tray to the collation station followed by the manual feeding of an insert from the second insert tray to the collation station; said second arrangement for the manual feeding of an insert from the second insert tray to the collation station followed by the automatic feeding of an insert from the first insert tray to the collation station.

5. An infeed apparatus according to claim 1 wherein the sensor means comprises an optical sensor apparatus disposed to project an optical beam which is intersected by inserts traveling from one of the first and second insert trays to the collation station; and the apparatus includes processor means for processing outputs of said sensor apparatus.

6. An infeed apparatus according to claim 5, wherein the processor means includes memory means and is selectively operable in a calibration mode in which data characteristic of the output of the sensor apparatus on sensing a presence of a single insert is stored in said memory means; and a subsequent, active mode in which the stored data is compared with data characteristic of the output of the sensor apparatus to ascertain if any inserts are intersecting the optical beam, and if more than one insert is intersecting the optical beam, the processor including means for generating a signal indicative of at least detection of a number of inserts intersecting the optical beam.

7. An infeed apparatus according to claim 1 including control means permitting operation of the apparatus in one of the following modes;

(i) automatically to feed inserts singly from the first insert tray to the collation station;

(ii) to permit manual feeding of inserts from the second insert tray to the collation station; and (iii) to permit combined feeding of inserts respectively automatically and manually from the first and second insert trays to the collation station, the control means controlling at least one of the means for temporarily arresting inserts and the drive means to arrest inserts at the collation station until the feeding of inserts is successfully completed and then expel the inserts via a further feed path for processing in the paper handling apparatus, the successful completion of feeding being determined by the control means in accordance with outputs of the sensor means.

8. An infeed apparatus according to claim 1 wherein the drive means includes a driven roller disposed adjacent the first insert tray and driveable to drive a single insert at a time towards the collation station via the feed path connecting the first insert tray to the collation station.

9. An infeed apparatus according to claim 8 wherein an idler roller is selectively moveable into and out of driving engagement with a driveable roller disposed adjacent the collation station.

10. An infeed apparatus according to claim 9 including means for moving the idler roller out of driving engagement simultaneously with actuation of the means for temporarily arresting inserts at the collation station.

11. An infeed apparatus according to claim 10 wherein the driveable roller and the idler roller, when the driveable roller is stationary, are adapted to arrest inserts in the collation station.

12. An infeed apparatus according to claim 1 wherein the feed path between the first insert tray and the collation station includes separator means to assist in ensuring that only a single inset at a time is driven towards the collation station.

13. An infeed apparatus according to claim 1 wherein the drive means includes a selectively driveable roller disposed in the feed path and adjacent the collation station to drive inserts into and expel inserts from the collation station.

14. An infeed apparatus according to claim 13 including an idler roller disposed opposite the driveable roller to guide inserts into and out of the collation station.

15. An infeed apparatus according to claim 14 wherein the driveable roller and the idler roller are operable to drive inserts into the collation station only when an insert is fed automatically from one of said insert trays.

16. An infeed apparatus according to claim 14 wherein the driveable roller is operable to expel inserts from the collation station only when an insert is fed manually from one of the insert trays.

17. An infeed apparatus according to claim 1 wherein the means for temporarily arresting the inserts in the collation station comprises a gate moveable between a first position in which the gate blocks passage of the inserts in the collation station and a second position which permits the passage of inserts in the collation station, the gate being resiliently biased to occupy the second position; and a solenoid and actuator arrangement for moving the gate between the first and second positions.

* * * * *